US011932288B2

(12) United States Patent
Li et al.

(10) Patent No.: US 11,932,288 B2
(45) Date of Patent: Mar. 19, 2024

(54) DOUBLE-DECK RAIL VEHICLE AND VEHICLE BODY THEREOF

(71) Applicant: CRRC TANGSHAN CO., LTD., Hebei (CN)

(72) Inventors: Zhishen Li, Tangshan (CN); Jijun Ma, Tangshan (CN); Letian Fan, Tangshan (CN); Chao Luo, Tangshan (CN); Likui Guo, Tangshan (CN); Zhe Qu, Tangshan (CN); Dongbo Li, Tangshan (CN); Shuoshao Zhang, Tangshan (CN)

(73) Assignee: CRRC TANGSHAN CO., LTD., Hebei (CN)

( * ) Notice: Subject to any disclaimer, the term of this patent is extended or adjusted under 35 U.S.C. 154(b) by 393 days.

(21) Appl. No.: 17/418,205

(22) PCT Filed: Jun. 12, 2019

(86) PCT No.: PCT/CN2019/090808
§ 371 (c)(1),
(2) Date: Jun. 24, 2021

(87) PCT Pub. No.: WO2020/133935
PCT Pub. Date: Jul. 2, 2020

(65) Prior Publication Data

US 2022/0111876 A1 Apr. 14, 2022

(30) Foreign Application Priority Data

Dec. 25, 2018 (CN) ..... 201811593560.7

(51) Int. Cl.
*B61D 1/06* (2006.01)
*B61D 17/04* (2006.01)
(Continued)

(52) U.S. Cl.
CPC ..... *B61D 1/06* (2013.01); *B61D 17/041* (2013.01); *B61D 17/043* (2013.01); *B61D 17/08* (2013.01); *B61D 17/10* (2013.01); *B61D 17/12* (2013.01)

(58) Field of Classification Search
CPC ..... B61D 1/06; B61D 17/041; B61D 17/043; B61D 17/08; B61D 17/10; B61D 17/12; B61D 3/02; B61D 17/00; B61F 1/08
See application file for complete search history.

(56) References Cited

U.S. PATENT DOCUMENTS 813,667 A * 2/1906 Pulliam ..... B61D 3/20 105/420
1,367,429 A * 2/1921 Psilander ..... B61D 17/10 213/40 R
(Continued)

FOREIGN PATENT DOCUMENTS

CN 1117001 A 2/1996
CN 102501866 A 6/2012
(Continued)

OTHER PUBLICATIONS

International Search Report in the international application No. PCT/CN2019/090808, dated Sep. 30, 2019.
Written Opinion of the International Search Authority in the international application No. PCT/CN2019/090808, dated Sep. 30, 2019.

*Primary Examiner* — Scott A Browne
(74) *Attorney, Agent, or Firm* — Syncoda LLC; Feng Ma

(57) ABSTRACT

A double-deck rail vehicle and a vehicle body thereof are provided. An underframe (11) of the vehicle body comprises a lower-layer underframe (111), end underframes (112, 115), sealing plates (114, 116), and side underframes (118, 119); wherein the lower-layer underframe is provided with an underframe middle beam (1111); the end underframe is fixedly connected to the underframe middle beam by means of reinforcement middle beams (113, 117); the sealing plate
(Continued)

is fixedly connected between the end underframe and the lower-layer underframe; and the side underframe comprises side beams (1181, 1191) of the side underframe that are integrated, and the side underframe is fixedly connected to the end underframe by means of the side beams of the side underframe. The vehicle body supplements the reinforcement middle beams capable of increasing the connection strength between the end underframe and the lower-layer underframe, and uses the integrated side beams of the side underframe. Therefore, the structure strength, rigidity and compression-resistant performance of the vehicle body can be enhanced, so that the safety of the double-deck rail vehicle can be improved, and a problem that a related double-deck vehicle body does not satisfy the requirements of America strength standard can be solved.

19 Claims, 8 Drawing Sheets

(51) Int. Cl.

| | |
|---|---|
| *B61D 17/08* | (2006.01) |
| *B61D 17/10* | (2006.01) |
| *B61D 17/12* | (2006.01) |

(56) References Cited

U.S. PATENT DOCUMENTS

| | | | | | |
|---|---|---|---|---|---|
| 2,612,121 | A * | 9/1952 | Kuhler | B61D 1/08 105/340 |
| 2,985,118 | A * | 5/1961 | Maharick | B61D 39/00 105/377.01 |
| 4,130,068 | A | 12/1978 | Stark | |
| 4,331,083 | A * | 5/1982 | Landregan | B61D 9/06 105/247 |
| 9,067,606 | B2 | 6/2015 | Taguchi | |
| 2014/0150688 | A1 | 6/2014 | Taguchi | |

FOREIGN PATENT DOCUMENTS

| | | | | |
|---|---|---|---|---|
| CN | 103661443 | A | 3/2014 | |
| CN | 105015571 | A | 11/2015 | |
| CN | 105946886 | A | 9/2016 | |
| CN | 106184245 | A | 12/2016 | |
| CN | 107738658 | A | 2/2018 | |
| CN | 108313084 | A | 7/2018 | |
| DE | 19603028 | C1 | 3/1997 | |
| EP | 0697319 | A1 | 2/1996 | |
| EP | 0697319 | B1 | 5/2000 | |
| IN | 104724133 | A | 6/2015 | |
| KR | 20160017472 | A | 2/2016 | |
| NL | 2001214 | C2 * | 7/2009 | B61D 3/18 |

* cited by examiner

DOUBLE-DECK RAIL VEHICLE AND VEHICLE BODY THEREOF

CROSS-REFERENCE TO RELATED APPLICATIONS

The present application is a national stage of International Application No. PCT/CN2019/090808 filed on Jun. 12, 2019, which claims priority to Chinese Patent Application No. 201811593560.7, filed on Dec. 25, 2018. The disclosures of these applications are hereby incorporated by reference in their entirety.

TECHNICAL FIELD

The disclosure relates to the field of rail vehicle, and in particular to a double-deck rail vehicle and vehicle body thereof.

BACKGROUND

In recent years, with the rapid development of China's rail transit industry, rail vehicles have been exported to developed countries in Europe and America. In order to develop the North American market, it is necessary to design a vehicle body structure that meets American strength standards. The demand for rail vehicle has gradually has transferred from single-deck vehicle to double-deck vehicle in some countries, such as United States, Canada and other. However, vehicle body structures of double-deck rail vehicles in the related art do not meet American strength standard requirements.

SUMMARY

Embodiments of the present application provide a double-deck rail vehicle and a vehicle body thereof. In the vehicle body, a reinforcing center sill capable of increasing the connection strength is provided between an end chassis and a lower chassis, and an lateral chassis side beam in one-piece structure is adopted. Therefore, the structural strength, rigidity, and compression resistance of the vehicle body can be enhanced, so that the safety of the double-deck rail vehicle can be improved, and the problem in the related art that double-deck vehicle bodies do not meet American strength standard requirements can be solved.

According to a first aspect of the embodiments of the present application, a vehicle body is provided, which may include a chassis, a front end wall, a rear end wall, two side walls, and a roof. The chassis may include:

- a lower chassis provided with a chassis center sill extending in a length direction of the vehicle body;
- a first end chassis fixedly connected to one end of the chassis center sill through a first reinforcing center sill;
- a first closure plate fixedly connected between the first end chassis and the lower chassis, the first closure plate is configured to seal a gap between the first end chassis and the lower chassis;
- a second end chassis opposite to the first end chassis, the second end chassis is fixedly connected to the other end of the chassis center sill through a second reinforcing center sill;
- a second closure plate fixedly connected between the second end chassis and the lower chassis, the second closure plate is configured to seal a gap between the second end chassis and the lower chassis;

- a first lateral chassis comprising a first lateral chassis side beam formed in one piece, the first lateral chassis is fixedly connected to the first end chassis and the second end chassis through the first lateral chassis side beam; and
- a second lateral chassis opposite to the first lateral chassis, the second lateral chassis comprising a second lateral chassis side beam formed in one piece, and the second lateral chassis is fixedly connected to the first end chassis and the second end chassis through the second lateral chassis side beam.

In some examples, each of the first end chassis and the second end chassis comprises a front end beam, a rear end beam, two end chassis side beams, a sleeper beam and a traction beam. A force transmission beam is welded between the sleeper beam and the rear end beam and is located at a position corresponding to the traction beam.

The end chassis side beam comprises a U-shaped steel with an opening facing the traction beam, and a side beam closure plate welded to the opening. Each of the U-shaped steel and the side beam closure plate is formed in one piece.

An end, away from the traction beam, of the end chassis side beam has a variable cross-section structure which cause the cross-sectional area of the end chassis side beam to be gradually reduced in a direction from the front end beam to the rear end beam.

In some examples, floor cross beams are welded between the end chassis side beam and the traction beam and between the end chassis side beam and the force transmission beam. A stainless steel floor is welded on a side, away from the traction beam, of the floor cross beam. A floor longitudinal beam is welded on the surface of a side, facing the traction beam, of the stainless steel floor, to improve the rigidity of the stainless steel floor.

In some examples, the front end wall comprises two front anti-collision pillars, two front end corner pillars, a front end upper cross beam, a front end lower cross beam and a front end wall plate. The two front anti-collision pillars and the two front end corner pillars extend parallel to one another in a vertical direction. The two front anti-collision pillars are located between the two front end corner pillars. the front end upper cross beam and the front end lower cross beam extend parallel to one another in a horizontal direction and are perpendicular to the two front anti-collision pillars and the two front end corner pillars. A plurality of front end wall connecting beams are fixedly connected between the front anti-collision pillar and the front end corner pillar.

The rear end wall may include two rear anti-collision pillars, two rear end corner pillars, a rear end upper cross beam, a rear end lower cross beam and a rear end wall plate. The two rear anti-collision pillars and the two rear end corner pillars may extend parallel to one another in a vertical direction. The two rear anti-collision pillars may be located between the two rear end corner pillars. The rear end upper cross beam and the rear end lower cross beam may extend parallel to one another in a horizontal direction, and may be perpendicular to the two rear anti-collision pillars and the two rear end corner pillars. A plurality of rear end wall connecting beams may be fixedly connected between the rear anti-collision pillar and the rear end corner pillar.

In some examples, the front end lower cross beam of the front end wall may be welded with the traction beam at one end of the chassis and the end chassis side beam through a full penetration weld, and a plurality of front end connecting beams may be welded between the front end lower cross beam and the front end beam at one end of the chassis.

The rear end lower cross beam of the rear end wall may be welded with the traction beam at the other end of the chassis through a full penetration weld, and a passenger step may be welded between the rear end lower cross beam and the front end beam at the other end of the chassis.

In some examples, a step connecting beam for adjusting a connection position may be further arranged between the passenger step, the rear end lower cross beam and the front end beam.

In some examples, the passenger step may include a support plate and a step board welded to one another, the step board may be made of a stainless steel plate having a thickness of 3 mm, and the support plate may be made of a stainless steel plate having a thickness of 4 mm.

In some examples, a top of each of the two front anti-collision pillars and the two rear anti-collision pillars may be provided with a lifting lug.

In some examples, the traction beam may include a traction beam bottom plate, a traction beam cover plate, a first vertical plate, a second vertical plate, a coupler panel, a horizontal support plate, and a vertical support plate.

The traction beam cover plate and the traction beam bottom plate may be arranged to one another in a vertical direction.

The first vertical plate and the second vertical plate may be arranged to one another and may be welded between the traction beam bottom plate and the traction beam cover plate respectively.

The coupler panel may be arranged in the vertical direction, with one side surface of the coupler panel for installing a coupler, the other side surface for installing the horizontal support plate. The coupler panel may be welded with the traction beam bottom plate, the traction beam cover plate, the first vertical plate and the second vertical plate respectively. An installation space may be formed on one side of the coupler panel where the coupler is installed, and a cavity may be formed on the other side, away from the coupler, of the coupler panel.

The horizontal support plate may be located in the cavity, and may be welded with the coupler panel, the first vertical plate and the second vertical plate.

The vertical support plate may be located in the cavity, and may be welded with the traction beam cover plate, the first vertical plate and the second vertical plate.

In some examples, there may be at least two horizontal support plates arranged parallel to one another. The lengths of the horizontal support plates may gradually change in a direction from the traction beam cover plate to the traction beam bottom plate.

In some examples, the side wall may include a side wall frame, a window assembly, and a side wall plate. An outer side surface of the side wall plate may be a smooth wire drawing plate. The side wall plate may be fixedly connected to the side wall frame through a spot welding process.

The side wall may be fixedly connected to the front end wall and the rear end wall through a connecting plate.

In some examples, the roof may include a central roof and connecting structures arranged at two ends of the central roof. The connecting structures are configured for connecting the central roof with the front end wall and the rear end wall.

The central roof may include a roof frame formed by a longitudinal beam and a roof bending beam, and a top plate connected to the roof frame by spot welding.

The connecting structure may include a roof connecting beam and a roof cover plate fixedly connected to a top of the roof connecting beam.

In some examples, the roof may be made of a stainless steel material, and the top plate may be made of a stainless steel corrugated plate having a thickness of 4 mm.

In some examples, the roof bending beam may be welded with an upper side beam of the side wall, and the top plate and the traction beam cover plate may be welded with the side wall plate respectively.

In some examples, a second deck floor fixedly connected to the side wall may be further included. The second deck floor may be configured to divide the vehicle body into a double-deck structure.

In some examples, the second deck floor may be formed by splicing and welding aluminum profiles.

In some examples, the second deck floor may be riveted to the side wall frame, and an anti-corrosion structure may be arranged between the second deck floor and the side wall frame.

In some examples, the second deck floor may be riveted to the side wall frame through Huck rivets, and the anti-corrosion structure may be an anti-corrosion liner plate for preventing an electrochemical reaction between the second deck floor and the side wall frame.

In some examples, the lower chassis may be provided with two chassis center sills arranged in parallel.

The chassis may be provided with two first reinforcing center sills arranged in parallel and two second reinforcing center sills arranged in parallel. The first reinforcing center sills may be connected to the chassis center sills in a one-to-one correspondence manner. The second reinforcing center sills may be connected to the chassis center sills in a one-to-one correspondence manner.

According to a second aspect of the embodiments of the present application, a double-deck rail vehicle is provided, which may include any one vehicle body as provided in the above technical solution.

By adopting the double-deck rail vehicle and the vehicle body thereof provided in the embodiments of the present application, the reinforcing center sill capable of increasing the connection strength is added between the end chassis and the lower chassis in the vehicle body, and the lateral chassis side beam in one-piece structure is adopted. Meanwhile, the vehicle body is made of a stainless steel material. Therefore, the structural strength, rigidity, and compression resistance of the vehicle body can be enhanced, so that the safety of the double-deck rail vehicle can be improved, and the problem in the related art that vehicle bodies cannot meet American strength standard requirements can be solved.

BRIEF DESCRIPTION OF THE DRAWINGS

The accompanying drawings described herein serve to provide a further understanding of the present application, and constitute a part of the present application. The exemplary embodiments of the present application and the descriptions thereof serve to explain the present application, but do not unduly limit the present application. In the drawings.

REFERENCE NUMERALS

1: vehicle body; 11: chassis; 12: front end wall; 13: rear end wall; 14: side wall; 15: roof; 16: second deck floor;

111: lower chassis; 112: first end chassis; 113: first reinforcing center sill; 114: first closure plate; 115: second end chassis; 116: second closure plate; 117: second reinforcing center sill; 118: first lateral chassis; 119: second lateral chassis; 121: front anti-collision pillar; 122: front end corner pillar; 123: front end upper cross beam; 124: front end lower cross beam; 125: front end wall plate; 126: lifting lug;

1111: chassis center sill; 1121: front end beam; 1122: rear end beam; 1123: end chassis side beam; 1124: sleeper beam; 1125: traction beam; 1126: force transmission beam; 1127: floor cross beam; 1128: stainless steel floor; 1129: floor longitudinal beam; 1181: first lateral chassis side beam; 1191: second lateral chassis side beam;

11251: traction beam bottom plate; 11252: traction beam cover plate; 11253: first vertical plate; 11254: second vertical plate; 11255: coupler panel; 11256: horizontal support plate; 11257: vertical support plate.

DETAILED DESCRIPTION

In the process of implementing the present application, the skilled person has found that there is still a gap in the related art in the research on a double-deck vehicle body structure meeting American standards.

Aiming at the above problem, the embodiments of the present application provide a double-deck rail vehicle and a vehicle body thereof. In the vehicle body, a reinforcing center sill capable of increasing the connection strength is supplemented between an end chassis and a lower chassis, and an integrally-formed lateral chassis side beam is adopted. Therefore, the structural strength, rigidity, and compression resistance of the vehicle body can be enhanced, so that the safety of the double-deck rail vehicle can be improved.

To further clarify the technical solutions and advantages of the embodiments of the present application, exemplary embodiments of the present application will now be described in further detail with reference to the accompanying drawings. It is apparent that the described embodiments are only a part of the embodiments of the present application and are not exhaustive of all embodiments. It is to be noted that the embodiments of the present application and the features in the embodiments may be combined without conflict.

Figure 1:
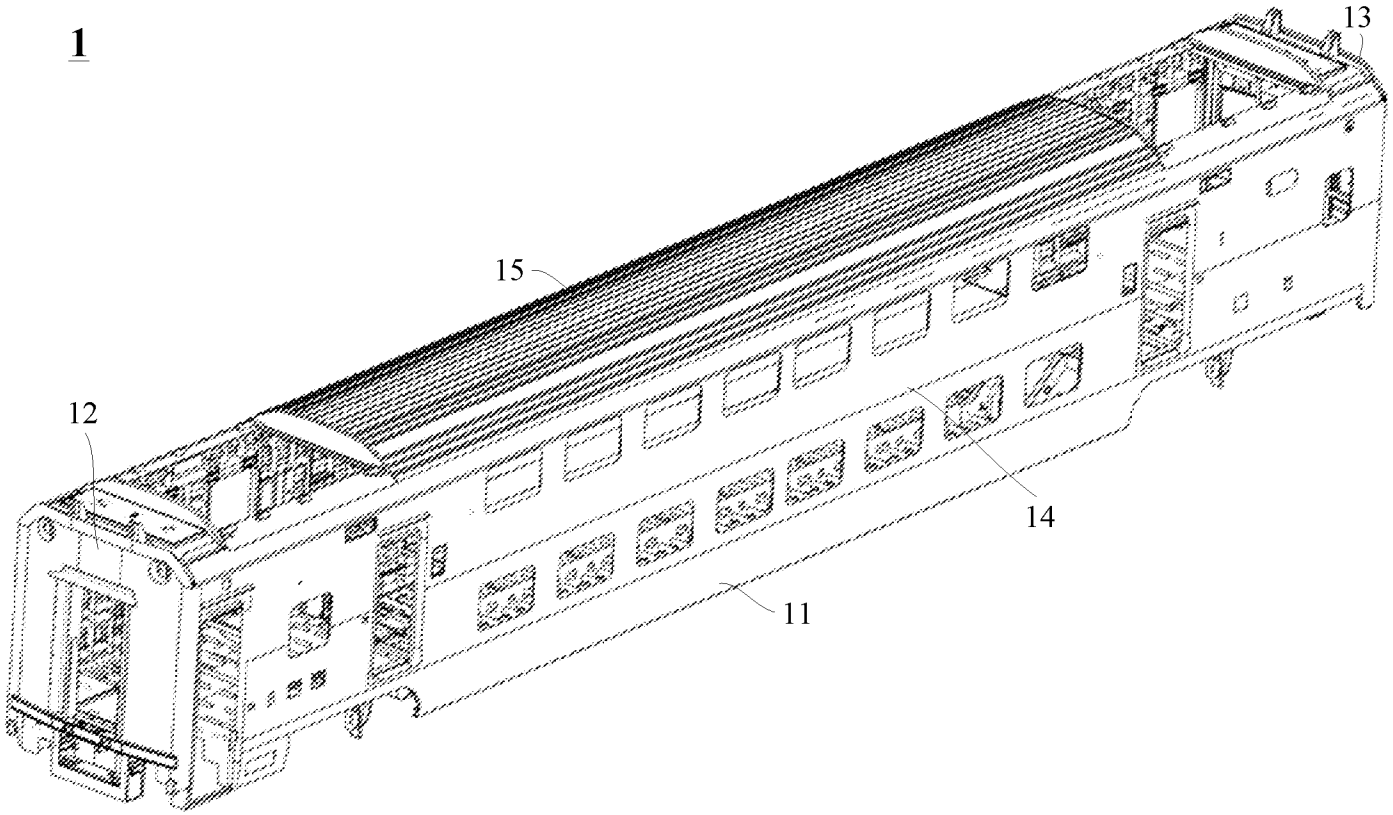
FIG. 1 illustrates a schematic diagram of a vehicle body according to an embodiment of the present application.
Figure 2:
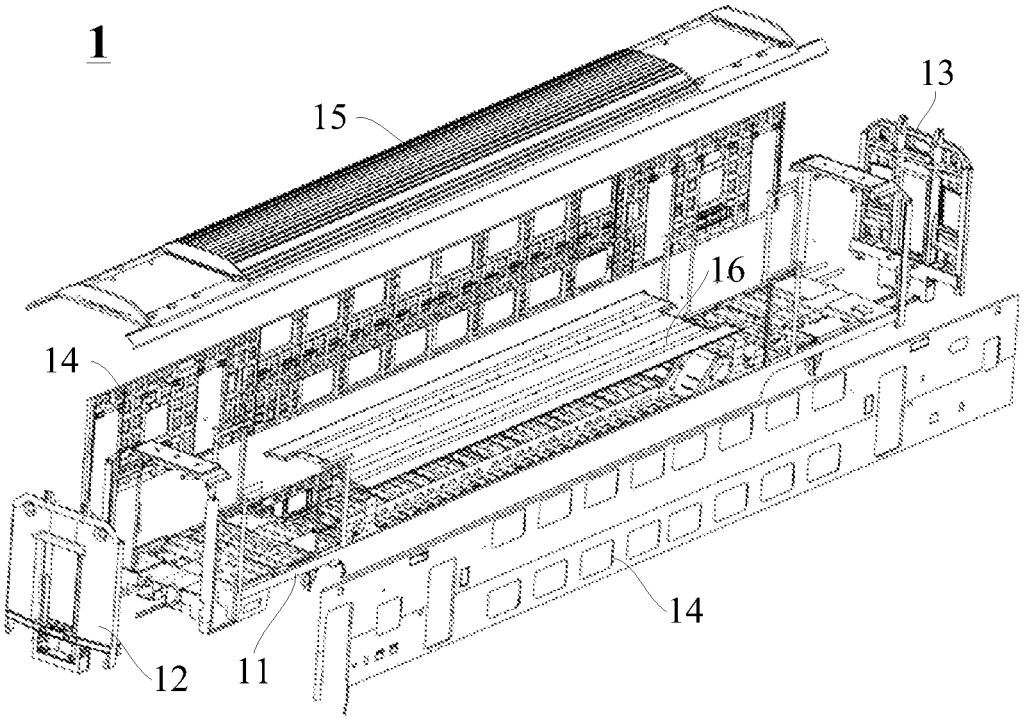
FIG. 2 illustrates a schematic exploded diagram of a vehicle body according to an embodiment of the present application.
Figure 3:
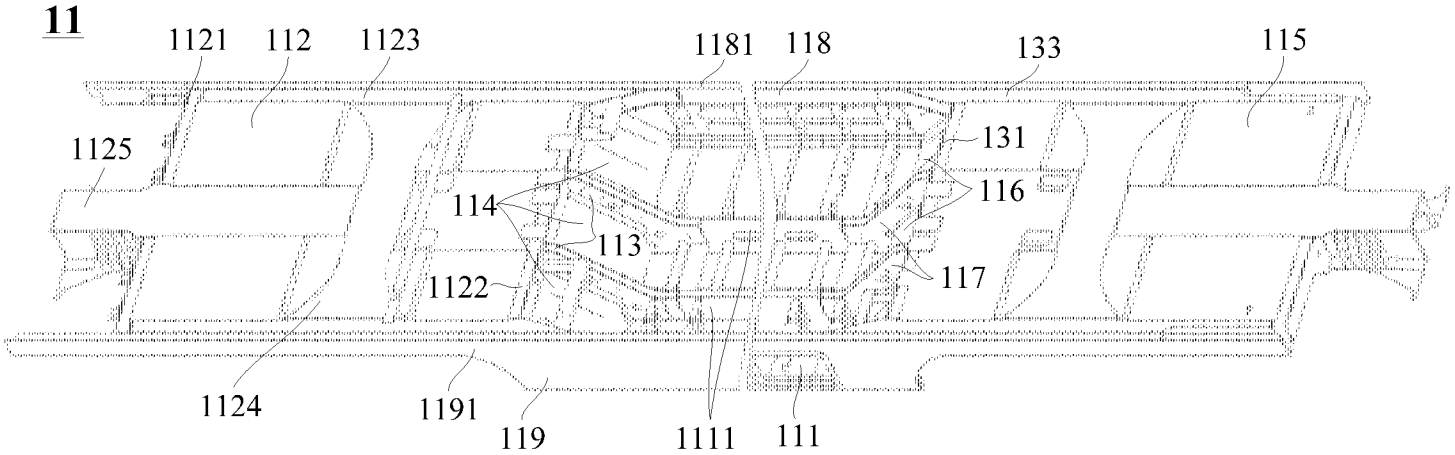
FIG. 3 illustrates a schematic diagram of a chassis of the vehicle body in FIG. 1.

An embodiment of the present application provides a vehicle body 1. As shown in FIGS. 1 and 2, the vehicle body 1 includes a chassis 11, a front end wall 12, a rear end wall 13, two side walls 14, and a roof 15. As shown in FIG. 3, the chassis 11 includes: a lower chassis, a first end chassis, a first closure plate, a second end chassis, a second closure plate, a first lateral chassis, and a second lateral chassis.

The lower chassis 111 is provided with a chassis center sill 1111 extending in a length direction of the vehicle body 1. In the present embodiment, for example, the lower chassis 111 is provided with two parallel chassis center sills 1111 in FIG. 3, and an extending direction of the chassis center sill 1111 is the same as a length direction of a rail vehicle.

The first end chassis 112 is fixedly connected to one end of the chassis center sill 1111 through a first reinforcing center sill 113. As shown in FIG. 3, the first end chassis 112 may be provided with a rear end beam 1122 fixedly connected to the lower chassis 111, a traction beam 1125 for mounting a coupler and an end chassis side beam 1123 for connecting with the lateral chasses. The first end chassis 112 is located at one end of the lower chassis 111, and the second end chassis 115 is located at the other end of the lower chassis 111. The chassis 11 is provided with two parallel first reinforcing center sills 113. The first reinforcing center sills 113 have a one-on-one correspondence to the chassis center sills 1111. One end of each first reinforcing center sill 113 is fixedly connected to the respective chassis center sill 1111, and the other end is fixedly connected to the rear end beam 1122 of the first end chassis 112. The first end chassis 112 is fixedly connected to the lower chassis 111 through the two parallel first reinforcing center sills 113.

The first closure plate 114 is fixedly connected between the first end chassis 112 and the lower chassis 111, and is configured to seal a gap between the first end chassis 112 and the lower chassis 111. As shown in FIG. 3, a plurality of first closure plates 114 are fixedly connected between the first end chassis 112 and the lower chassis 111, and the first closure plates 114 seal gaps between the first end chassis 112 and the lower chassis 111 while being fixedly connected to the first end chassis 112 and the lower chassis 111, so as to isolate the spaces inside and outside the vehicle body.

The second end chassis 115 is opposite to the first end chassis 112, and is fixedly connected to the other end of the chassis center sill 1111 through a second reinforcing center sill 117. As shown in FIG. 3, the chassis 11 is provided with two parallel second reinforcing center sills 117. The second reinforcing center sills 117 have a one-on-one correspondence to the chassis center sills 1111. One end of each second reinforcing center sill 117 is fixedly connected to the respective chassis center sill 1111, and the other end is fixedly connected to the rear end beam 1122 of the second end chassis 115. The second end chassis 115 is fixedly connected to the lower chassis 111 through the two parallel second reinforcing center sills 117.

The second closure plate 116 is fixedly connected between the second end chassis 115 and the lower chassis 111, and is configured to seal a gap between the second end chassis 115 and the lower chassis 111. As shown in FIG. 3, the second closure plate 116 is fixedly connected between the second end chassis 115 and the lower chassis 111, and is configured to seal the gap between the second end chassis 115 and the lower chassis 111. A plurality of second closure plates 116 are fixedly connected between the second end chassis 115 and the lower chassis 111, and the second closure plates 116 seal gaps between the second end chassis 115 and the lower chassis 111 while being fixedly connected to the second end chassis 115 and the lower chassis 111, so as to isolate the spaces inside and outside the vehicle body.

The first lateral chassis 118 includes a first lateral chassis side beam 1181 formed in one piece. The first lateral chassis 118 is fixedly connected to the first end chassis 112 and the second end chassis 115 through the first lateral chassis side beam 1181. Both the first lateral chassis 118 and the second lateral chassis 119 are fixedly connected to the lower chassis 111, the first end chassis 112 and the second end chassis 115.

The second lateral chassis 119 is arranged opposite to the first lateral chassis 118. The second lateral chassis 119 includes a second lateral chassis side beam 1191 formed in one piece. The second lateral chassis 119 is fixedly connected to the first end chassis 112 and the second end chassis 115 through the second lateral chassis side beam 1191.

In the chassis 11 of the vehicle body 1, the first end chassis 112 is fixedly connected to one end of each chassis center sill 1111 through the respective first reinforcing center sill 113; the second end chassis 115 is fixedly connected to the other end of the chassis center sill 1111 through the second reinforcing center sills 117; the first closure plate 114 is fixedly connected between the first end chassis 112 and the lower chassis 111, the second closure plate 116 is fixedly connected between the second end chassis 115 and the lower chassis 111; and the gaps between the first end chassis 112 and the lower chassis 111 and between the second end chassis 115 and the lower chassis 111 are sealed through the closure plates. Meanwhile, each of the first lateral chassis side beam 1181 of the first chassis 118 and the second lateral chassis side beam 1191 of the second lateral chassis 119 is formed in one piece. The structural strength and rigidity of the first lateral chassis 118 and the second lateral chassis 119 can be improved by the first lateral chassis side beam 1181 and the second lateral chassis side beam 1191 in one-piece structure, so that the compression resistance of the chassis 11 is improved, and the chassis 11 can bear heavy loads. Due to the above structure, the structural strength, rigidity and compression resistance of the chassis 11 of the vehicle body 1 and thus the vehicle body 1 can be improved, the vehicle body 1 can meet American standards, thereby improving the safety and reliability of a double-deck rail vehicle.

Figure 4:
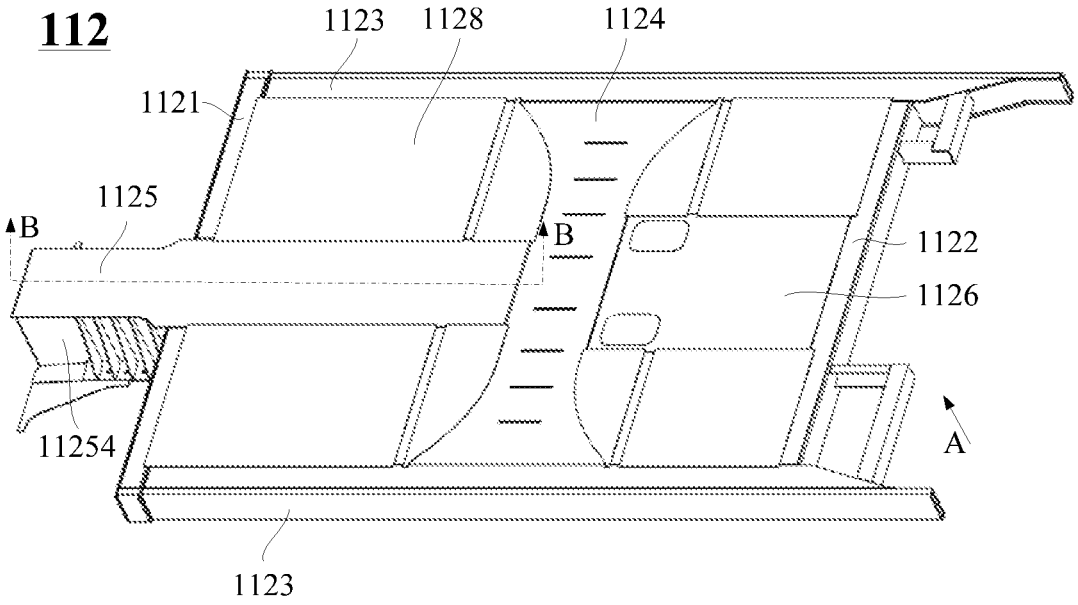
FIG. 4 illustrates a schematic diagram of an end chassis of the vehicle body in FIG. 1.
Figure 5:
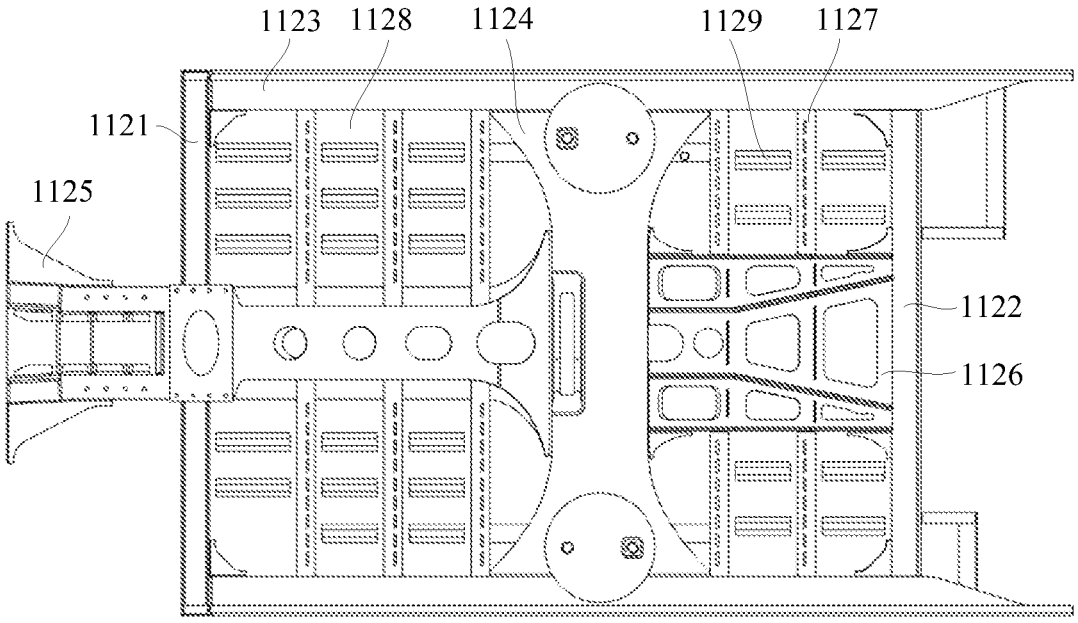
FIG. 5 illustrates a schematic diagram of the end chassis in FIG. 4 in direction A.

In a specific implementation, as shown in FIGS. 3, 4, and 5, each of the first end chassis 112 and the second end chassis 115 includes a front end beam 1121, a rear end beam 1122, two end chassis side beams 1123, a sleeper beam 1124 and a traction beam 1125. A force transmission beam 1126 is welded between the sleeper beam 1124 and the rear end beam 1122 and located a position corresponding to the traction beam 1125. The front end beam 1121, the rear end beam 1122 and the two end chassis side beams 1123 are welded to one another form a rectangular frame structure. The sleeper beam 1124 is welded to central regions of the two end chassis side beams 1123. The traction beam 1125 is welded to a side, facing the front end beam 1121, of the sleeper beam 1124 and to the front end beam 1121. The traction beam 1125 is welded onto one side of the sleeper beam 1124 and the force transmission beam 1126 is welded onto another side of the sleeper beam 1124. The force transmission beam 1126 may be linked with the chassis center sill 1111 of the lower chassis 111 so as to transmission high-pressure heavy loads.

The end chassis side beam 1123 includes U-shaped steel with an opening facing the traction beam 1125 and a side beam closure plate welded to the opening. Each of U-shaped steel and the side beam closure plate is formed in one piece. Due to the U-shaped steel and the side beam closure plate, the cross section of the end chassis side beam 1123 forms a rectangular structure, so that the structural strength and rigidity of the end chassis side beam 1123 are improved, and the bearing capacity of the end chassis side beam 1123 is further improved. Meanwhile, each of the U-shaped steel and the side beam closure plate which form the end chassis side beam 1123 is in one piece structure. Since each of the U-shaped steel and the side beam closure plate is in one piece structure, welding can be avoided, welding workload is reduced, and various parameters such as flatness of the end chassis side beam 1123 are also improved.

An end, away from the traction beam 1125, of the end chassis side beam 1123 has a variable cross-section structure, and the variable cross-section structure cause the cross-sectional area of the end chassis side beam 1123 to be gradually reduced in a direction from the front end beam 1121 to the rear end beam 1122. An end, close to the rear end beam 1122, of the end chassis side beam 1123 has a variable cross-section structure, i.e., the cross-sectional area of the end chassis side beam 1123 at this portion is gradually reduced in a direction from the front end beam 1121 to the rear end beam 1122, so that when the end chassis is connected to the lower chassis 111, the stress concentration between the end chassis side beam 1123 and the chassis side beam in a compression working condition of the vehicle can be reduced.

A force transmission beam 1126 is welded between the sleeper beam 1124 and the rear end beam 1122 of the end chassis and is located at a position corresponding to the traction beam 1125. The force transmission beam 1126 is opposite to the chassis center sill 1111 of the lower chassis 111, and the load borne by the traction beam 1125 can be transmitted to the lower chassis 111 through the force transmission beam 1126. Each of the U-shaped steel and the side beam closure plate of the end chassis side beam 1123 is in one piece structure, and one end of the end chassis side beam 1123 has the variable cross-section structure, so that the structural strength and rigidity of the end chassis side beam 1123 are improved, heavy loads can be borne and transmitted. Then the heavy loads borne by the traction beam 1125 and the sleeper beam 1124 can be transmitted simultaneously by the force transmission beam 1126 and the end chassis side beam 1123, and the compression stress borne by the traction beam 1125 can be dispersed. In addition, gradual transition can be realized by the connection of the variable cross-section structure of the end chassis side beam 1123 with the lower chassis side beam, so that stress concentration is avoided, the force transmission effect is great, welding workload in the assembly process can be reduced, the flatness of the end chassis side beam 1123 can be guaranteed, and the process performance is excellent. Therefore, the end chassis can meet the requirements of compression resistance and heavy loads.

As shown in FIGS. 4 and 5, cross beams 1127 for floor (called floor cross beams) are welded between the end chassis side beam 1123 and the traction beam 1125 and between the end chassis side beam 1123 and the force transmission beam 1126. A stainless steel floor 1128 is welded on a side, away from the traction beam 1125, of the floor cross beam 1127. A longitudinal beam 1129 for the floor (called floor longitudinal beam) is welded on the surface of a side, facing the traction beam 1125, of the stainless steel floor 1128, and the floor longitudinal beam 1129 is configured to improve the rigidity of the stainless steel floor 1128. The stainless steel floor 1128 may have a thickness of 2 mm to 3 mm, e.g., 2 mm, 2.2 mm, 2.3 mm, 2.5 mm, 2.7 mm, 2.8 mm, or 3 mm.

In the end chassis, the installation of stainless steel floor 1128 is facilitated by the floor cross beam 1127 welded between the end chassis side beam 1123 and the traction beam 1125, and between the end chassis side beam and the force transmission beam 1126. Meanwhile, the structural strength and rigidity of the end chassis are further improved through the floor cross beam 1127 and the stainless steel floor 1128. The strength and rigidity of the stainless steel floor 1128 can be improved through the floor longitudinal beam 1129 welded to one side of the stainless steel floor 1128.

Figure 8:
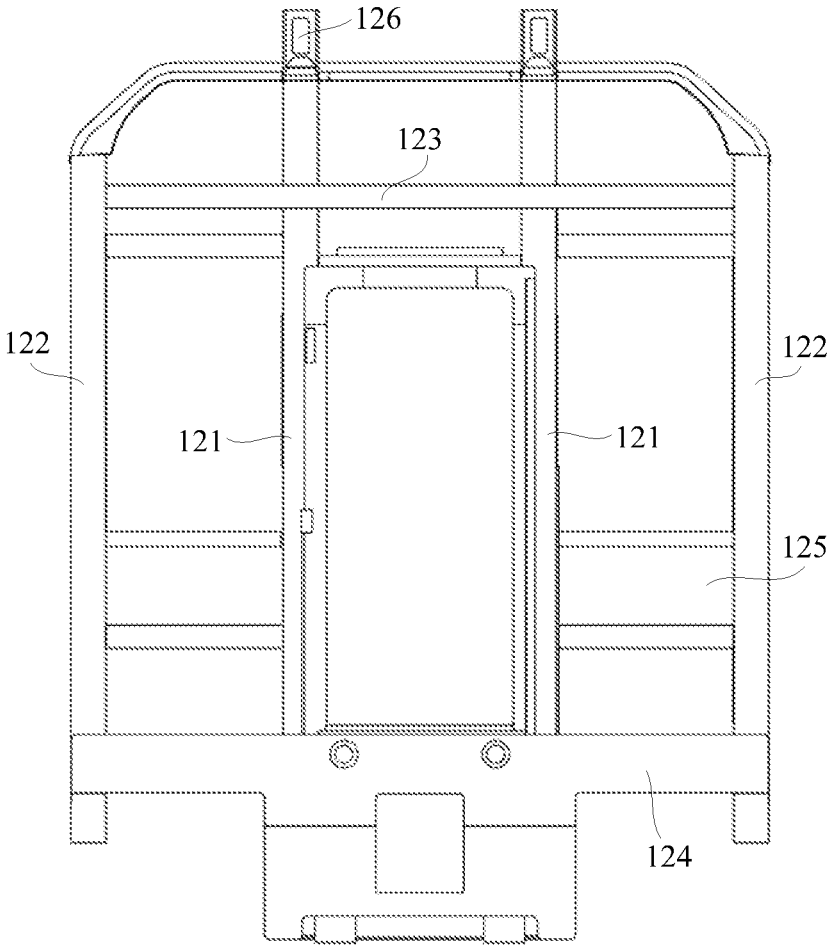
FIG. 8 illustrates a schematic structure diagram of a front end wall of the vehicle body in FIG. 2.

As shown in FIG. 8, the front end wall 12 includes two front anti-collision pillars 121, two front end corner pillars 122, a front end upper cross beam 123, a front end lower cross beam 124, and a front end wall plate 125. The two front anti-collision pillars 121 and the two front end corner pillars 122 extend parallel to each other in a vertical direction. The two front anti-collision pillars 121 are located between the two front end corner pillars 122. The front end upper cross beam 123 and the front end lower cross beam 124 extend parallel to each other in a horizontal direction and are perpendicular to the two front anti-collision pillars 121 and the two front end corner pillars 122. A plurality of connecting beams of the front end wall 12 are fixedly connected between the front anti-collision pillar 121 and the front end corner pillar 122.

The rear end wall 13 includes two rear anti-collision pillars, two rear end corner pillars, a rear end upper cross beam, a rear end lower cross beam, and a rear end wall plate. The two rear anti-collision pillars and the two rear end corner pillars extend parallel to each other in a vertical direction. The two rear anti-collision pillars are located between the two rear end corner pillars. The rear end upper cross beam and the rear end lower cross beam extend parallel to each other in a horizontal direction, and are perpendicular to with the two rear anti-collision pillars and the two rear end corner pillars. A plurality of connecting beams of the rear end wall 13 are fixedly connected between the rear anti-collision pillar and the rear end corner pillar.

By arranging the anti-collision pillars with higher structural strength on the front end wall 12 and the rear end wall 13, the structural strength of the vehicle body 1 can be improved while the structural strength of the end walls is improved, and the deformation and damage of the vehicle after impact can be reduced, thereby guaranteeing the safety of personnel in the vehicle.

In order to improve the connection strength between the end walls and the chassis 11, the front end lower cross beam 124 of the front end wall 12 is welded with the traction beam 1125 at one end of the chassis 11 and with the end chassis side beam 1123 through a full penetration weld, and a plurality of front end connecting beams are welded between the front end lower cross beam 124 and the front end beam 1121 at one end of the chassis 11.

The rear end lower cross beam of the rear end wall 13 is welded with the traction beam 1125 at the other end of the chassis 11 through a full penetration weld, and a passenger step is welded between the rear end lower cross beam and the front end beam 1121 at the other end of the chassis 11. As shown in FIG. 2, a step connecting beam for adjusting a connection position is further arranged between the passenger step, the rear end lower cross beam and the front end beam 1121. The passenger step includes a support plate and a step board welded to one another, the step board is made of a stainless steel plate having a thickness of 3 mm, and the support plate is made of a stainless steel plate having a thickness of 4 mm.

As shown in FIGS. 1 and 8, the top of each of the two front anti-collision pillars 121 and the two rear anti-collision pillars is provided with a lifting lug 126, i.e., two lifting lugs 126 are arranged at each of two ends of the vehicle body 1.

The lifting lugs 126 arranged on the end walls can facilitate lifting of the vehicle body 1 so as to facilitate lifting of the vehicle body 1 during rescue or maintenance of the vehicle.

Figure 6:
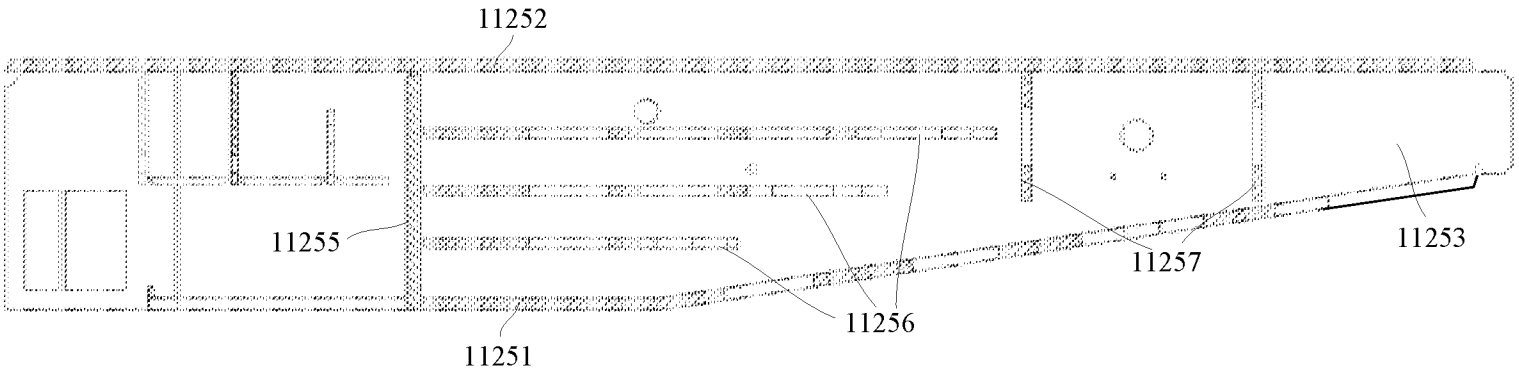
FIG. 6 illustrates a cross-sectional schematic diagram of a traction beam in FIG. 4 in direction B-B.

As shown in FIG. 6, the traction beam 1125 includes a traction beam bottom plate 11251, a traction beam cover plate 11252, a first vertical plate 11253, a second vertical plate 11254, a coupler panel 11255, a horizontal support plate 11256, and a vertical support plate 11257.

The traction beam cover plate 11252 and the traction beam bottom plate 11251 are arranged opposite to one another in a vertical direction.

The first vertical plate 11253 and the second vertical plate 11254 are arranged opposite to one another and are welded between the traction beam bottom plate 11251 and the traction beam cover plate 11252 respectively.

The coupler panel 11255 is arranged in the vertical direction, with one side surface for installing a coupler, and the other side surface for installing the horizontal support plate 11256. The coupler panel 11255 is welded with the traction beam bottom plate 11251, the traction beam cover plate 11252, the first vertical plate 11253, and the second vertical plate 11254 respectively. An installation space is formed on the side of the coupler panel 11255 where the coupler is installed, and a cavity is formed on the other side, away from the coupler, of the coupler panel 11255.

The horizontal support plate 11256 is located in the cavity, and is welded with the coupler panel 11255, the first vertical plate 11253 and the second vertical plate 11254.

The vertical support plate 11257 is located in the cavity, and is welded with the traction beam cover plate 11252, the first vertical plate 11253, and the second vertical plate 11254.

The bottom plate 11251, the cover plate 11252, the first vertical plate 11253, and the second vertical plate 11254 of the traction beam 1125 are welded to one another to form a rectangular chamber. The coupler panel 11255 is arranged in the chamber, and the periphery of the coupler panel 11255 is welded to the bottom plate 11251, the cover plate 11252, the first vertical plate 11253 and the second vertical plate 11254. As such, an installation space for installing a coupler is formed on one side of the coupler panel 11255, and a cavity is formed on a side, away from the coupler, of the coupler panel 11255, so that the traction beam 1125 forms a box structure on the rear side of the coupler panel 112545. In addition, the horizontal support plate 11256 and the vertical support plate 11257 are welded in the cavity. Due to the horizontal support plate 11256 welded together with the coupler panel 11255, the first vertical plate 11253, and the second vertical plate 11254, the structural strength and rigidity of the traction beam 1125 can be enhanced, and the compression resistance of the traction beam 1125 in the horizontal direction can be improved. Due to the vertical support plate 11257 welded together with the cover plate 11252, the first vertical plate 11253, and the second vertical plate 11254, the structural strength and rigidity of the traction beam 1125 can be further enhanced, and the compression resistance of the traction beam 1125 in the vertical direction can be improved. Therefore, the traction beam 1125 has higher structural strength and rigidity, the compression resistance can be enhanced, and the vehicle body 1 meets the bearing requirements of a heavy compression working condition (e.g. a compression working condition of 3560 kN).

In the structure of the traction beam 1125, as shown in FIG. 6, there are at least two horizontal support plates 11256. The at least two horizontal support plates 11256 are arranged parallel to one another. In comparison with each other, the lengths of the horizontal support plates 11256 gradually changes in a direction from the traction beam cover plate 11252 to the traction beam bottom plate 11251.

By means of the at least two horizontal support plates 11256 arranged in the cavity of the traction beam 1125, the structural strength and rigidity of the coupler panel 11255 can be enhanced while the acting force of the coupler on the coupler panel 11255 can be dispersed and transmitted to the first vertical plate 11253 and the second vertical plate 11254 through the horizontal support plates 11256. Therefore, by the arrangement of the additional horizontal support plates 11256, the structural strength and rigidity of the traction beam 1125 can be further improved, the acting force of the coupler can be quickly dispersed and transmitted, stress concentration is avoided, and the compression resistance of the traction beam 1125 is improved.

In the structure of the vehicle body 1, as shown in FIGS. 1 and 2, the side wall 14 includes a side wall frame, a window assembly, and a side wall plate. An outer side surface of the side wall plate is a smooth wire drawing plate. The side wall plate is fixedly connected to the side wall frame through a spot welding process. The side wall 14 is fixedly connected to the front end wall 12 and the rear end wall 13 through a connecting plate. Certainly, in the structure of the side wall 14, in order to increase the structural strength and rigidity of the side wall 14, additional plate-shaped members, additional rod-shaped members, etc., which enhance the structural strength, may also be added to the side wall 14.

In the structure of the vehicle body 1, as shown in FIG. 2, the roof 15 includes a central roof 151 and connecting structures 152 arranged at two ends of the central roof 151. The connecting structures 152 are configured to connect the central roof 151 with the front end wall 12 and the rear end wall 13.

The central roof 151 includes a roof frame formed by a longitudinal beam 1511 and a roof bending beam 1512, and a top plate 1513 connected to the roof frame by spot welding. Both the longitudinal beam 1511 and the roof bending beam 1512 may be made of a stainless steel material adopting the 301L-1/8H\ASTM A666-2015 standard. The top plate 1513 may be made of a stainless steel corrugated plate having a thickness of 4 mm. The connecting structure 152 includes a roof connecting beam 1521 and a roof cover plate 1522 fixedly connected to the top of the roof connecting beam 1521.

In the roof 15, a roof frame is formed by a roof bending beam 1512 and a longitudinal beam 1511, so that the structural strength and rigidity of the roof 15 can be enhanced. Meanwhile, the top plate 1513 is made of a stainless steel corrugated plate, so that the structural strength of the roof 15 can be further improved.

In a specific connection process of the roof 15, the roof bending beam 1512 is welded with an upper side beam of the side wall 14 through a fillet weld, and the top plate 1513 and the traction beam cover plate 11252 are welded with the side wall plate respectively. The roof bending beam 1512 may be a zigzag beam. In order to realize double-sided welding of the roof bending beam 1512 and the upper side beam of the side wall 14, a part of the flanging of the roof bending beam 1512 may be cut off, or double-sided welding may be performed by adding a connecting plate. Meanwhile, the difficulty in controlling an assembly gap between the roof bending beam 1512 and the upper side beam of the side wall 14 can be reduced.

The vehicle body 1 further includes a second deck floor 16 fixedly connected to the side wall 14. The second deck floor 16 is configured to divide the vehicle body 1 into a double-deck structure. The second deck floor 16 is formed by splicing and welding aluminum profiles. The second deck floor 16 may be riveted to the side wall frame through Huck rivets, and an anti-corrosion structure is arranged between the second deck floor 16 and the side wall frame. The anti-corrosion structure is an anti-corrosion liner plate for preventing an electrochemical reaction between the second deck floor 16 and the side wall frame. The anti-corrosion liner plate may be made of plastics, rubber, and other materials.

Figure 7:
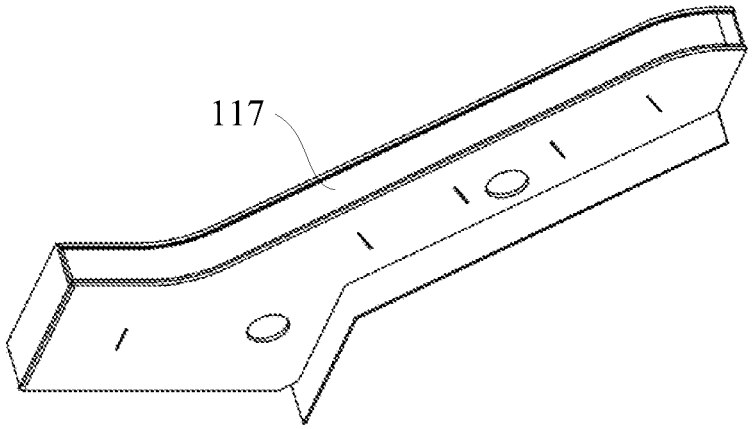
FIG. 7 illustrates a schematic structure diagram of a second reinforcing center sill of the chassis in FIG. 3.

On the basis of the various embodiments of the vehicle body 1, as shown in FIGS. 3 and 7, the lower chassis 111 is provided with two chassis center sills 1111 arranged in parallel. The chassis 11 is provided with two first reinforcing center sills 113 arranged in parallel and two second reinforcing center sills 117 arranged in parallel. The first reinforcing center sills 113 are connected to the chassis center sills 1111 in a one-to-one correspondence manner. The second reinforcing center sills 117 are connected to the chassis center sills 1111 in a one-to-one correspondence manner.

The two chassis center sills 1111 parallel to one another are arranged in the lower chassis 111, and the first end chassis 112 is fixedly connected to the chassis center sills 1111 through the first reinforcing center sills 113 corresponding to the chassis center sills 1111 one by one, so that the first end chassis 112 is fixedly connected to the lower chassis 111. Meanwhile, the second end chassis 115 is fixedly connected to the chassis center sills 1111 through the second reinforcing center sills 117 corresponding to the chassis center sills 1111 one by one, so that the second end chassis 115 is fixedly connected to the lower chassis 111. Since the structural strength of the chassis center sill 1111, the first reinforcing center sill 113, and the second reinforcing center sill 117 are high, the first reinforcing center sill 113 and the second reinforcing center sill 117 are adopted to enable the two end chasses to be installed on the lower chassis 111, so that the connection strength between the end chassis and the lower chassis 111 can be improved. Meanwhile, the arrangement of reinforced structures can be reduced, and uniform stress of the chassis center sill 1111 can be realized.

An embodiment of the present application also provides a double-deck rail vehicle. The double-deck rail vehicle includes the vehicle body 1 as provided in any of the above embodiments.

By adopting the double-deck rail vehicle and the vehicle body 1 thereof provided in the embodiments of the present application, the reinforcing center sill capable of increasing the connection strength is supplemented between the end chassis and the lower chassis 111 in the vehicle body 1, and the integrally-formed lateral chassis side beam is adopted. Therefore, the structural strength, rigidity, and compression resistance of the vehicle body 1 can be enhanced, so that the safety of the double-deck rail vehicle can be improved, and the problem in the related art that vehicle bodies cannot meet American strength standard requirements can be solved.

While some alternative embodiments of the present application have been described, those skilled in the art can make additional changes and modifications to the embodiments once knowing a basic creativity concept. Therefore, the appended claims are intended to be interpreted as including the alternative embodiments and all the changes and modifications falling within the scope of the present application.

It is apparent that those skilled in the art can make various modifications and variations to the present application without departing from the spirit and scope of the present application. Thus, if such modifications and variations of the present application fall within the scope of the appended claims and their equivalents, the present application is also intended to cover the modifications and variations.

The invention claimed is:

1. A vehicle body, comprising a chassis, a front end wall, a rear end wall, side walls, and a roof, wherein the chassis comprises:

a lower chassis provided with a chassis center sill extending in a length direction of the vehicle body;

a first end chassis fixedly connected to one end of the chassis center sill through a first reinforcing center sill;

a first closure plate fixedly connected between the first end chassis and the lower chassis, the first closure plate being configured to seal a gap between the first end chassis and the lower chassis;

a second end chassis opposite to the first end chassis, the second end chassis being fixedly connected to the other end of the chassis center sill through a second reinforcing center sill;

a second closure plate fixedly connected between the second end chassis and the lower chassis, the second closure plate being configured to seal a gap between the second end chassis and the lower chassis;

a first lateral chassis comprising a first lateral chassis side beam formed in one piece, the first lateral chassis being fixedly connected to the first end chassis and the second end chassis through the first lateral chassis side beam; and a second lateral chassis opposite to the first lateral chassis, the second lateral chassis comprising a second lateral chassis side beam formed in one piece, and the second lateral chassis being fixedly connected to the first end chassis and the second end chassis through the second lateral chassis side beam, wherein each of the first end chassis and the second end chassis comprises a front end beam, a rear end beam, two end chassis side beams, a sleeper beam, and a traction beam, a force transmission beam being welded between the sleeper beam and the rear end beam and located at a position corresponding to the traction beam;

the end chassis side beam comprises a U-shaped steel with an opening facing the traction beam and a side beam closure plate welded to the opening, each of the U-shaped steel and the side beam closure plate being formed in one piece; and an end, away from the traction beam, of the end chassis side beam has a variable cross-section structure which cause the cross-sectional area of the end chassis side beam to be gradually reduced in a direction from the front end beam to the rear end beam.

2. The vehicle body according to claim 1, wherein floor cross beams are welded between the end chassis side beam and the traction beam and between the end chassis side beam and the force transmission beam, a stainless steel floor being welded on a side, away from the traction beam, of the floor cross beam, and a floor longitudinal beam is welded on the surface of a side, facing the traction beam, of the stainless steel floor, to improve the rigidity of the stainless steel floor.

3. The vehicle body according to claim 1, wherein the front end wall comprises two front anti-collision pillars, two front end corner pillars, a front end upper cross beam, a front end lower cross beam and a front end wall plate, the two front anti-collision pillars and the two front end corner pillars extending parallel to one another in a vertical direction, the two front anti-collision pillars being located between the two front end corner pillars, the front end upper cross beam and the front end lower cross beam extending parallel to one another in a horizontal direction and being perpendicular to the two front anti-collision pillars and the two front end corner pillars, a plurality of front end wall connecting beams being fixedly connected between the front anti-collision pillar and the front end corner pillar; and the rear end wall comprises two rear anti-collision pillars, two rear end corner pillars, a rear end upper cross beam, a rear end lower cross beam and a rear end wall plate, the two rear anti-collision pillars and the two rear end corner pillars extending parallel to one another in a vertical direction, the two rear anti-collision pillars are located between the two rear end corner pillars, the rear end upper cross beam and the rear end lower cross beam extending parallel to one another in a horizontal direction and being perpendicular to the two rear anti-collision pillars and the two rear end corner pillars, a plurality of rear end wall connecting beams being fixedly connected between the rear anti-collision pillar and the rear end corner pillar.

4. The vehicle body according to claim 3, wherein the front end lower cross beam of the front end wall is welded with the traction beam at one end of the chassis and the end chassis side beam through a full penetration weld, a plurality of front end connecting beams being welded between the front end lower cross beam and the front end beam at one end of the chassis; and the rear end lower cross beam of the rear end wall is welded with the traction beam at the other end of the chassis through a full penetration weld, and a passenger step being welded between the rear end lower cross beam and the front end beam at the other end of the chassis.

5. The vehicle body according to claim 4, wherein a step connecting beam for adjusting a connection position is further arranged between the passenger step, the rear end lower cross beam and the front end beam.

6. The vehicle body according to claim 4, wherein the passenger step comprises a support plate and a step board welded to one another, the step board being made of a stainless steel plate having a thickness of 3 mm, and the support plate being made of a stainless steel plate having a thickness of 4 mm.

7. The vehicle body according to claim 3, wherein a top of each of the two front anti-collision pillars and the two rear anti-collision pillars is provided with a lifting lug.

8. The vehicle body according to claim 1, wherein the traction beam comprises a traction beam bottom plate, a traction beam cover plate, a first vertical plate, a second vertical plate, a coupler panel, a horizontal support plate, and a vertical support plate, wherein the traction beam cover plate and the traction beam bottom plate are arranged opposite to one another in a vertical direction;

the first vertical plate and the second vertical plate are arranged opposite to one another and are welded between the traction beam bottom plate and the traction beam cover plate respectively;

the coupler panel is arranged in the vertical direction, with one side surface of the coupler panel for installing a coupler, the other side surface for installing the horizontal support plate, the coupler panel being welded with the traction beam bottom plate, the traction beam cover plate, the first vertical plate and the second vertical plate respectively, an installation space being formed on one side of the coupler panel where the coupler is installed, and a cavity being formed on the other side, away from the coupler, of the coupler panel;

the horizontal support plate is located in the cavity, and welded with the coupler panel, the first vertical plate and the second vertical plate; and the vertical support plate is located in the cavity, and welded with the traction beam cover plate, the first vertical plate and the second vertical plate.

9. The vehicle body according to claim 8, wherein there are at least two horizontal support plates arranged parallel to one another, the lengths of the horizontal support plates gradually changes in a direction from the traction beam cover plate to the traction beam bottom plate.

10. The vehicle body according to claim 3, wherein the side wall comprises a side wall frame, a window assembly and a side wall plate, an outer side surface of the side wall plate being a smooth wire drawing plate, the side wall plate being fixedly connected to the side wall frame through a spot welding process; and the side wall is fixedly connected to the front end wall and the rear end wall through a connecting plate.

11. The vehicle body according to claim 10, wherein the roof comprises a central roof and connecting structures arranged at two ends of the central roof, the connecting structures being configured for connecting the central roof with the front end wall and the rear end wall;

the central roof comprises a roof frame formed by a longitudinal beam and a roof bending beam, and a top plate connected to the roof frame by spot welding; and the connecting structure comprises a roof connecting beam and a roof cover plate fixedly connected to a top of the roof connecting beam.

12. The vehicle body according to claim 11, wherein the roof is made of a stainless steel material, and the top plate is made of a stainless steel corrugated plate having a thickness of 4 mm.

13. The vehicle body according to claim 11, wherein the roof bending beam is welded with an upper side beam of the side wall, the top plate and the traction beam cover plate being welded with the side wall plate respectively.

14. The vehicle body according to claim 10, further comprising a second deck floor fixedly connected to the side wall, the second deck floor being configured to divide the vehicle body into a double-deck structure.

15. The vehicle body according to claim 14, wherein the second deck floor is formed by splicing and welding aluminum profiles.

16. The vehicle body according to claim 15, wherein the second deck floor is riveted to the side wall frame, an anti-corrosion structure being arranged between the second deck floor and the side wall frame.

17. The vehicle body according to claim 16, wherein the second deck floor is riveted to the side wall frame through rivets, the anti-corrosion structure being an anti-corrosion liner plate for preventing an electrochemical reaction between the second deck floor and the side wall frame.

18. The vehicle body according to claim 1, wherein the lower chassis is provided with two chassis center sills arranged in parallel; and the chassis is provided with two first reinforcing center sills arranged in parallel and two second reinforcing center sills arranged in parallel, the first reinforcing center sills being connected to the chassis center sills in a one-to-one correspondence manner, and the second reinforcing center sills being connected to the chassis center sills in a one-to-one correspondence manner.

19. A double-deck rail vehicle, comprising a vehicle body, wherein the vehicle body comprises: a chassis, a front end wall, a rear end wall, side walls and a roof, wherein the chassis comprises:

a lower chassis provided with a chassis center sill extending in a length direction of the vehicle body;

a first end chassis fixedly connected to one end of the chassis center sill through a first reinforcing center sill;

a first closure plate fixedly connected between the first end chassis and the lower chassis, the first closure plate being configured to seal a gap between the first end chassis and the lower chassis;

a second end chassis opposite to the first end chassis, the second end chassis being fixedly connected to the other end of the chassis center sill through a second reinforcing center sill;

a second closure plate fixedly connected between the second end chassis and the lower chassis, the second closure plate being configured to seal a gap between the second end chassis and the lower chassis;

a first lateral chassis comprising a first lateral chassis side beam formed in one piece, the first lateral chassis being fixedly connected to the first end chassis and the second end chassis through the first lateral chassis side beam; and a second lateral chassis opposite to the first lateral chassis, the second lateral chassis comprising a second lateral chassis side beam formed in one piece, and the second lateral chassis being fixedly connected to the first end chassis and the second end chassis through the second lateral chassis side beam, wherein each of the first end chassis and the second end chassis comprises a front end beam, a rear end beam, two end chassis side beams, a sleeper beam, and a traction beam, a force transmission beam being welded between the sleeper beam and the rear end beam and located at a position corresponding to the traction beam;

the end chassis side beam comprises a U-shaped steel with an opening facing the traction beam and a side beam closure plate welded to the opening, each of the U-shaped steel and the side beam closure plate being formed in one piece; and an end, away from the traction beam, of the end chassis side beam has a variable cross-section structure which cause the cross-sectional area of the end chassis side beam to be gradually reduced in a direction from the front end beam to the rear end beam.

* * * * *